US006634351B2

(12) United States Patent
Arabaolaza

(10) Patent No.: US 6,634,351 B2
(45) Date of Patent: Oct. 21, 2003

(54) THERMOSTATIC GAS VALVE WITH STANDING PILOT FLOW

(75) Inventor: Juan José Arabaolaza, Aretxabaleta (ES)

(73) Assignee: Fagor, S. Coop., Mondragon (ES)

( * ) Notice: Subject to any disclaimer, the term of this patent is extended or adjusted under 35 U.S.C. 154(b) by 49 days.

(21) Appl. No.: 09/982,202

(22) Filed: Oct. 16, 2001

(65) Prior Publication Data

US 2002/0189605 A1 Dec. 19, 2002

(30) Foreign Application Priority Data

Jun. 15, 2001 (ES) ..... 200101563 U

(51) Int. Cl.[7] ..... F24C 3/12

(52) U.S. Cl. ..... 126/39 G; 236/15 A; 137/862; 431/280

(58) Field of Search ..... 126/39 G, 42; 236/15 A; 137/861, 862, 66; 431/278, 279, 280, 281, 55, 90, 53, 54

(56) References Cited

U.S. PATENT DOCUMENTS 3,477,641 A * 11/1969 Fairley et al. ..... 137/66
3,861,587 A * 1/1975 Katchka ..... 431/54
4,085,891 A * 4/1978 Branson et al. ..... 236/15 A
4,765,536 A * 8/1988 Bergquist ..... 137/862
5,407,128 A * 4/1995 Schultz ..... 236/15 A

FOREIGN PATENT DOCUMENTS

EP 0 159 393 A1 * 10/1985 ..... F23N/1/00

* cited by examiner

*Primary Examiner*—Henry Bennett
*Assistant Examiner*—Josiah Cocks
(74) *Attorney, Agent, or Firm*—The Kline Law Firm

(57) ABSTRACT

A thermostatic gas valve structure for a kitchen oven comprises a valve body and a body cover, manual and thermostatic valves built into the body to regulate a main flow of said main burner, an actuating shaft traversing said cover and a rotary control coupled to the shaft. The actuating shaft is also provided with reciprocal axial movement so as to push a thermoelectric safety valve, and with a pilot flow passageway departing directly from the safety valve, in order to maintain a standing pilot flow independent of the control turning movements, in which the "off" and "pilot" position markers coincide.

3 Claims, 1 Drawing Sheet

THERMOSTATIC GAS VALVE WITH STANDING PILOT FLOW

BACKGROUND OF THE INVENTION

The present invention relates to a gas supply regulation valve for controlling combustion in a kitchen oven, provided with a valve body with main flow and pilot flow conduits and which includes at least one thermostatic valve and a safety valve energised by a pilot flame thermocouple.

Thermostatic valves for kitchen ovens that control a main gas flow supplied from an outlet to an oven burner and a pilot flow supplied from a second outlet to an oven pilot burner that ignites the main burner are already known. The known valves include a thermostatic regulating valve sensitive to oven temperature, and also a thermoelectric safety valve located in first place from the gas inlet conduit to the valve. The safety valve built into the valve body is energised by a pilot flame sensing thermocouple, keeping open the intake of gas into the valve from the valve inlet conduit. For the initial opening prior to ignition of the pilot burner, the safety valve electromagnet armature needs to be seated by means of an axial thrust on a rotary valve actuating shaft. The safety valve shuts off the intake of gas entirely if its electromagnet armature is de-energised, either by extinction of the pilot flame or by means of an electric switch interposed in the thermocouple.

Some types of kitchen ovens need a pilot ignited all the time, even when the oven is not in use for cooking, for which they have a pilot flow passageway departing directly from a pilot chamber located behind the safety valve, so that in a rotational OFF position of the control knob the pilot flow is not cut off by the regulating valve. For this purpose, the manual control of the known standing pilot valves has an exclusive rotational PILOT position for the independent supply of a pilot flow in which it is situated for the opening of the safety valve initially. In the PILOT position the manual control shaft is permitted to make an axial forth and back movement to push the safety valve and open it. The shaft is provided with a side shoulder, which engages in a groove in the valve housing in the PILOT position, and the shaft thereby makes a longer forward movement.

A known valve structure like the one cited above is described in U.S. Pat. No. 5,203,588, but the known valve has a rotational OFF position of the control in which an additional pilot chamber shut-off valve is actuated. Other valve structures like that described in U.S. Pat. No. 5,407,128 although they do not use an additional valve to control the pilot flow, the pilot flow is shut off by means of an electric switch in series with the thermocouple, actuated by the manual control in its rotational OFF position.

An example of a thermostatic regulating valve structure for use in a kitchen oven is described in U.S. Pat. No. 4,765,536. This valve structure comprises a manual rotary valve with a tapering shut-off member and a thermostatic capsule valve with a capillary tube of expandable liquid, both in series. But this latter valve structure does not have a built-in safety valve controlling the pilot flow, because it uses a safety valve with an independent and separate pilot flame connected from the outside to the thermostatic valve.

SUMMARY OF THE INVENTION

The object of the present invention is to provide a thermostatic gas valve structure for a kitchen oven, provided with a thermoelectric safety valve and a pilot flow passageway independent of the rotational actuating shaft position, in order to maintain a standing supply to an oven pilot burner, even after the main flow is shut off when its use for cooking has terminated.

The valve structure comprises a thermostatic valve body with an actuating shaft and a manual rotary control knob, and with two outlet conduits for connection to two respective oven burners, wherein a second one of the outlet conduits is adapted to provide a standing pilot flow for connection to the oven pilot burner by means of a passageway that departs directly from the safety valve. Thus, the control OFF and PILOT indications, for shutting off the main flow and initial pilot burner ignition respectively, coincide at a single position of the actuating shaft, the shut-off of the pilot flow takes place solely by means of de-energising the safety valve, and the pilot flow is supplied independently of the control knob rotation movements.

The thermostatic valve structure of the present invention also provides means for manual actuating of the safety valve for initial ignition of the pilot burner by means of an actuating shaft provided with axial reciprocating movement to push the safety valve until it is held in the actuating position by the energising of the thermocouple. The thermostatic valve structure is provided with a front cover traversed by the actuating shaft, which is adapted so that the axial forward movement of the actuating shaft to open the safety valve achieves a long travel in the actuating shaft PILOT position only, in which it is no able to be rotated and so as to prevent the possibility of the main flow being supplied before the pilot flow is ignited.

BRIEF DESCRIPTION OF THE DRAWINGS

FIG. 3 is a plan view of the manual control of the valve of

FIG. 1, showing rotational positions of the valve actuating shaft.

DETAILED DESCRIPTION OF THE INVENTION

Figure 2:
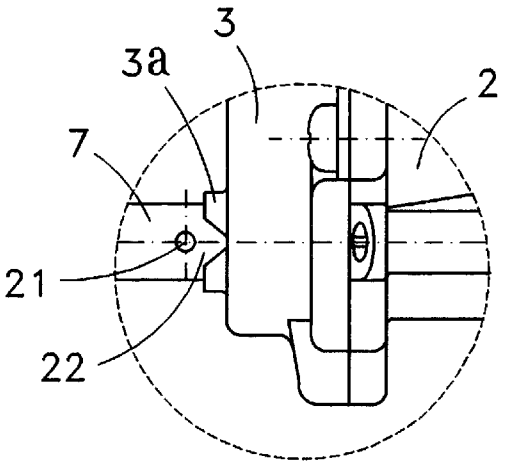
FIG. 2 is a close view according to line II of FIG. 1.
Figure 3:
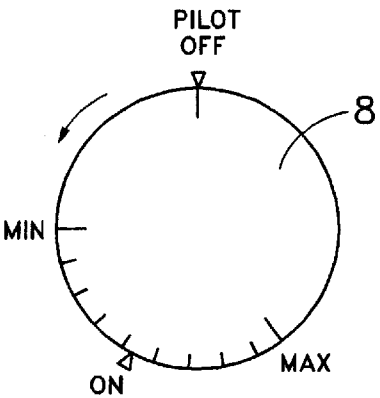
Figure 1:
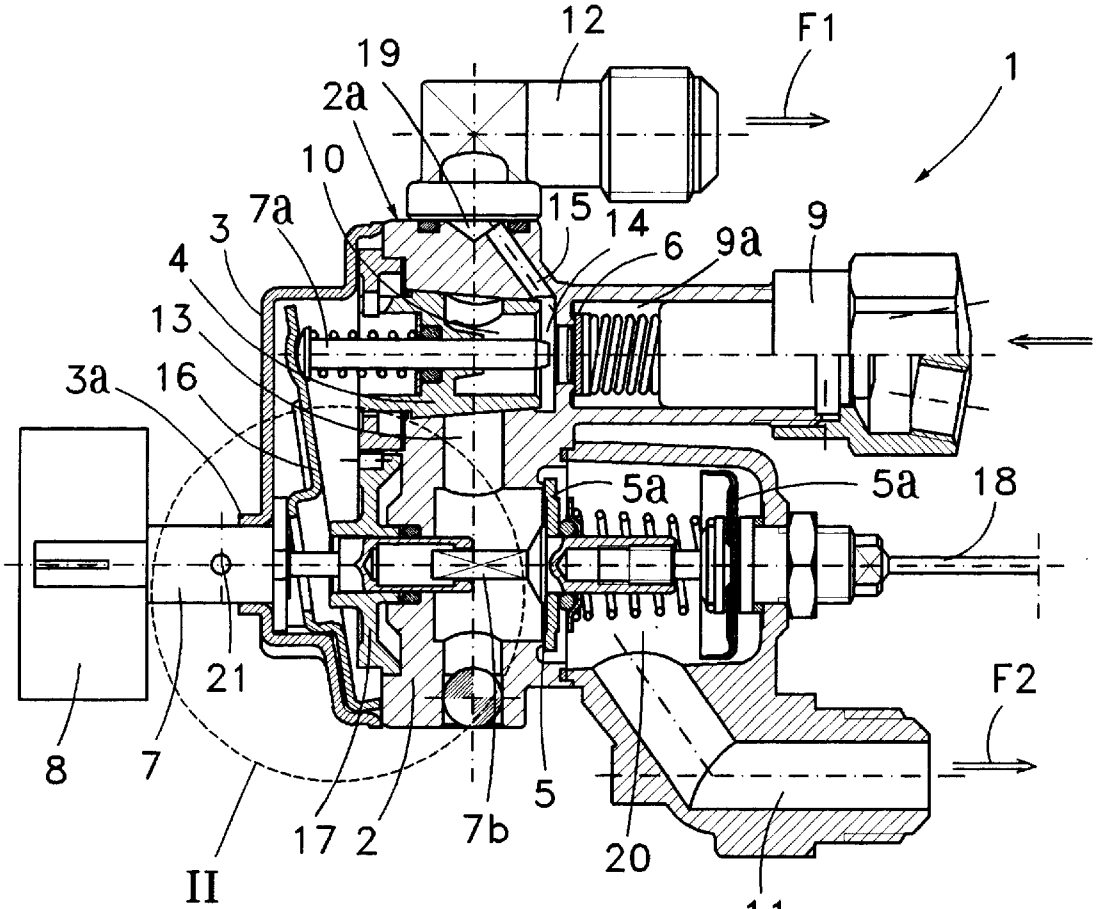
FIG. 1 is a sectional view of the thermostatic gas valve structure of the present invention.

With reference to FIGS. 1–3, a thermostatic gas valve structure according to the present invention is represented by the numeral 1. The thermostatic valve is combined with at last one main burner and a pilot burner for a kitchen oven, not represented in drawings. The thermostatic valve structure 1 comprises a valve body 2 with a front cover 3 and built into the body a main flow shut-off valve 4, a regulating valve 5 sensitive to the oven temperature for regulating a main flow F2 and communicated in series with the rotary valve 4, and a thermoelectric safety valve 6. In one example of embodiment the shut-off valve 4 is rotary type with a frustoconical shut-off member, and the thermostatic valve 5 is the capsule type regulated by a capillary tube 18 of fluid expandable with the temperature, both valves 4, 5 being arranged on parallel shafts spaced apart and forming respective gas chambers 10, 20 communicated by a hole 13 drilled in the body 2 of the valve structure.

The valve body 2 comprises an inlet conduit 9 connectable to a gas supply, wherein is housed the safety valve 6 forming an inlet chamber 9*a*, an outlet conduit 11 for the main flow F2 connectable to the oven main burner, which is modulated by the thermostatic valve 5, and an outlet conduit 12 connectable to the oven pilot burner, which supplies a pilot flow F1.

The valve structure further comprises an actuating shaft 7 with a coupled control knob 8. The shaft 7 traverses the cover 3 and is provided with a rotational movement for actuating the rotary valve 4 and adjustment of the thermostatic valve 5, and with an axial movement for acting on the safety valve 4 and opening it, at the initial start-up of the oven to ignite the pilot burner.

The actuating shaft is connected by a lever arm 16 to a rod 7*a* parallel to the actuating shaft, which, after a pressure on the control 8, pushes the safety valve 6 axially to open it. The actuating shaft 7 is also connected through a traversed disc 17 to a coaxial adjustment shaft 7*b* for actuation by means of its rotation on the thermostatic valve 5 adjusting the thermostatic travel of a plain shut-off valve member 5*a* between a minimum and a maximum flow valve openings. The actuating shaft 7 is connected to a disc 17, which also permits the rotation to the tapering member of the shut-off valve 4 at the same time by means of the turning of the control 8, for opening and closing the main flow F2.

For the axial forward movement of the shaft 7 and of its complementary rod 7*a*, shaft 7 (FIG. 2) has a pin 21 protruding sideways and the cover 3 has a groove which the pin 21 enters in a single rotational position of the shaft 7, permitting the control knob 8 to be depressed and so the axial forward movement of the shaft for opening the safety valve 6.

The gas chamber 10 formed by the rotary valve 4 is connected to the inlet conduit 9 by way of the safety valve 6 and transmits a main flow F2 towards the thermostatic valve 5 by way of the hole 13 only. The passageway to the hole 13 is opened or closed entirely by the frustoconical member of the rotary valve 4. The gas chamber 20 formed by the thermostatic valve 5 communicates directly with the outlet conduit 11 for the main flow F2. An intermediate gas chamber 14 is formed between the chamber 10 of the rotary valve 4 and the safety valve 6, and a passageway 15 is drilled in the valve body to connect the outlet conduit 12 directly to the intermediate chamber 14 in order to supply the pilot flow F1 when the safety valve 6 opens. The pilot flow via the passageway 15 may only be shut off by means of the safety valve 6.

The outlet conduit 12 is not integral with the body 2, the outlet conduit 12 for the pilot flow F1 is mounted on a flat outer surface 2A of the valve body 2 and attached by means of screws and a seal. The standing passageway 15 for the pilot flows F1 is drilled from the outer surface 2*a* at an angle of inclination in relation to the flat surface 2*a* to reach the gas chamber 18 situated immediately downstream of the safety valve. In order to facilitate the drilling of the hole 15, a recess 19 is previously machined inclined into the flat surface 2*a* for the right-angle penetration of the drill.

The rotary control knob 8 coupled to the actuating shaft 7 has the rotational positions marked as "PILOT", "OFF" and "ON" (FIG. 3). the last two referring to the main flow F2 of the oven and the PILOT position to the initial ignition of a pilot burner. In this last position the control may be pressed to move the shift 7 forward axially, and together with the latter the rod 7*a* that opens the safety valve 6. When the latter is thus actuated, passage of a pilot flow F1 is then set up via the passageway 15 towards the outlet conduit 12. In the PILOT position, once pressed, the control cannot be rotated and supply of the main flow is disabled until the pilot flame is ignited. The OFF position corresponds to the shut-off of the main flow F2, the passage thereof through the hole 13 communicating with the thermostatic valve 5 being sealed off. The OFF position coincides with the PILOT position as the pilot flow F1 is even supplied although the main flow F2 supply is shut off and the main burner extinguish. The safety valve 6 shuts off all entry of gas into the valve if the pilot flame is extinguished. Any other rotational position of knob 8 permits the ON condition of the passage of gas from the rotary valve 4 through the hole 3, and therefore a regulated passage of the main flow to the output conduit 11. In any of the ON positions (FIG. 3) of the knob 8 the shaft 7 may be turned to open up the main flow passageway 13, but it cannot be depressed, because the PILOT position of the rotary knob 8 is solely and unequivocally for the initial ignition of the pilot burner. The ON position of control 8 permits the adjustment of the thermostatic valve 5 between two positions, "MIN" and "MAX", which determine the limits of the main flow F2.

What is claimed is:

1. A thermostatic valve structure in combination with at least one main burner and a pilot burner for a kitchen oven, comprising:

a valve body, a valve body front cover and a valve actuating shaft traversing said valve body front cover and coupled to a manual rotary control knob;

a gas inlet conduit to said valve body for connection to a gas source, an outlet conduit to supply a main flow to said main burner, and a pilot flow outlet to supply a pilot flow to said pilot burner; and a safety valve housed in said inlet conduit and energised by a thermocouple, at least one manual valve controlled by said manual rotary control knob and connected in series with said safety valve, with sets up a main flow through said valve body, and a thermostatic valve sensitive to variations in oven temperature arranged in series with said manual valve so as to module the main flow output wherein said manual rotary control knob and said actuating shaft are provided with means for providing a rotation movement actuating said manual valve as well as a reciprocal axial movement actuating said safety valve; such that said pilot flow is constant regardless of a position of said manual rotary control knob, said pilot flow being activated during ignition of said pilot burner in a single position between said rotational positions coinciding with the main supply total shut-off position, a direct passage being opened from said safety valve to said pilot flow outlet conduit after a long axial displacement of said actuating shaft and wherein said actuating shaft and said front cover are provided with a pin protruding from said actuating shaft and a groove in said front cover which receives said pin in a plot position of said manual rotary control knob to prevent simultaneous rotation and axial movement of said actuating shaft.

2. The thermostatic gas valve structure defined in claim 1, wherein said pilot flow outlet conduit is mounted on an oar surface of said valve body, and said direct passage is set up through a hole from said outer surface of said valve body to an intermediate chamber immediately adjoining said safety valve.

3. The thermostatic gas valve structure defined in claim 1, wherein said actuating shaft means comprise a coaxial shaft that turns together with said actuating shaft to modulate said thermostatic valve between two main flow values, maximum and minimum, in a range of positions of said manual rotary control knob, and a traversed disc coupled to said actuating shaft which turns together with said actuating shaft to act on said manual rotary control valve.

* * * * *